US005681161A

United States Patent [19]

Ribot

[11] Patent Number: 5,681,161

[45] Date of Patent: Oct. 28, 1997

[54] LIGHTER

[76] Inventor: Carlos Moreno Ribot, Nena Casas, 56, 2° 1ª, Barcelona, Spain, 08017

[21] Appl. No.: 652,907

[22] Filed: May 23, 1996

[30] Foreign Application Priority Data

Jan. 5, 1996 [ES] Spain ..... 9600024

[51] Int. Cl.[6] ..... F23Q 1/02

[52] U.S. Cl. ..... 431/277; 431/275; 431/153

[58] Field of Search ..... 431/153, 277, 431/133, 136, 137, 138, 139, 140, 141, 275

[56] References Cited

U.S. PATENT DOCUMENTS 2,499,547 3/1950 Waggoner ..... 431/277

3,130,568 4/1964 Sero Mantero ..... 431/277

*Primary Examiner*—Carl D. Price

*Attorney, Agent, or Firm*—Darby & Darby

[57] ABSTRACT

The invention refers to a lighter which has a main body (1) and a cap (2); the main body (1) defines, in its upper part a tubular extension (12) to which is fixed an annular stone (5) and in its lower part a gas reservoir (11) equipped with a valve (3) with the corresponding burner (4). On the burner (4) an annular rasp (6) is mounted which is moveable and to which there is an associated bracket (8), and a spring (9) which pushes the afore-mentioned bracket (8) towards the upper part of the main body. The bracket (8) has lateral arms which protrude from the extension (12) through windows (13) and are located in cut-outs (24) defined in the interior of the cap (2). The recession of the cap (2) determines the action of a lever (10) which opens the gas valve (3) and the striking of the rasp (6) against the stone (5).

20 Claims, 3 Drawing Sheets

LIGHTER

AIM OF THE INVENTION

As indicated by the title, this invention relates to a lighter of the type which includes a gas reservoir with a valve, whose lighting mechanism causes a rasp to move against a stone. This mechanism produces the sparks needed to light the gas coming out through the valve; both the action of lighting and extinguishing the lighter is carried out by axially moving the cap on the top of the lighter.

BACKGROUND OF THE INVENTION

At present there are a large number of lighters with different operating mechanisms, in particular those for obtaining the sparks needed to light the gas coming from a reservoir, which comes through a valve usually operated by a lever.

Amongst the lighters available, we should mention those which produce the spark via a piezoelectric device, which when pressed causes a spark to pass between a cable on the piezoelectric unit and the top of the gas valve.

These lighters with piezoelectric devices allow a linear assembly of the different components which reduces the cross section of the lighter head but which has some serious disadvantages such as the need for specific environmental conditions for correct operation of the piezoelectric device and its high cost, which complicates production on an industrial level.

The other types of lighter available obtain the spark via a stone which presses radially on cylindrical rasp. By moving the rasp manually the sparks are thrown towards the gas output.

The lighters which obtain sparks in this way have a significantly lower cost as they do not include a piezoelectric device, but they require a larger head, as the stone and the rasp must be positioned parallel to the valve for the sparks to meet the gas emerging from it.

DESCRIPTION OF THE INVENTION

To solve these problems this new lighter has been created. The spark is obtained via the impact of a rasp on a stone, and here there are a number of advantages such as the possibility of axial assembly of the different components, thus reducing the cross section, low production costs as there is no piezoelectric element and easy operation, since both lighting and extinguishing is simply a matter of axial movement of a cap with respect to the main body of the lighter.

The top part of the main body includes a tubular extension inside the end of which an annular stone is placed. The bottom half includes a gas reservoir equipped with a valve and burner.

A rasp is assembled on the burner, which is moved axially, with a bracket associated with the rasp. A helicoidal spring is also placed above the burner whose lower part rests on a widened area of the burner and the upper part on the bottom of the bracket.

According to the invention, the inside of the annular stone has a frustoconical surface and the outside of the rasp also has a frustoconical surface but inclined opposite to that of the stone so that the rasp cannot pass through the stone.

According to the invention, the upper part of the rasp is oblique with irregular teeth so that when it is rubbed against the stone the irregular teeth meet different areas of the frustoconical surface of the inside of the stone, wearing it away irregularly and thus preventing it becoming stuck.

The lower end of this rasp has a tubular extension with a cutaway edge on which the bracket is mounted with sufficient play to move along the cutaway.

According to the invention the tubular extension of the main body has diametrically opposed side windows whose upper and lower ends are positioned obliquely and parallel. The arms of the bracket associated with the rasp pass through these windows.

Between the widened area of the burner and the body of the valve there is a operating lever which emerges radially from the main body through a window which has an inverted L-shaped configuration. This lever can rotate horizontally around the burner, and can be positioned over the vertical or the horizontal portion of the afore-mentioned window, meaning that it can be moved or not by the cap, depending on the relative position of the lever with respect to the window.

According to the invention, a spring has been placed between the cap and the main body which displaces the cap towards the outermost position possible with respect to the afore-mentioned main body, which maintains it normally in the off position of the lighter.

This cap defines an opening in the top for the exit of the flame and lateral slots for the entry of air required for combustion and two interior L-shaped cutaways which are diametrically opposed to one another. The ends of the arms of the bracket associated with the rasp are located in these cutaways.

When the cap is displaced towards the lower part of the lighter and the arm ends of the bracket are located in the horizontal part of the cutaways on the cap, the bracket is moved down, and compresses the spring which acts against the widened area of the burner, which in turn determines the recession of the rasp itself. Simultaneously, the lower end of the cap presses down on the lever which acts on the widened area of the burner which causes the gas to be released through the valve.

When the cap reaches the limit of its travel towards the lower part of the lighter, the arms of the bracket are released from the horizontal parts of the cap windows, given the oblique displacement of these arms over the lower ends of the windows in the main body. This causes the rasp to strike against the stone and generate the sparks required for lighting the gas which is coming out through the valve.

One of the features of this lighter is that the opening of the gas valve is carded out before the sparks are produced, given that the valve action lever is pressed down on by the cap before the rasp is rubbed against the stone which thus produces more efficient lighting.

When the cap is released, and the lighter is lit, it returns to its original position, releasing the lever which operates the gas valve, and the arms of the bracket, which are in contact with the lower areas of the upper, oblique ends of the side windows of the main body, can move over these oblique ends of the windows, the ends arms being once more located in the horizontal part corresponding to the windows of the cap. The lighter is thus extinguished and is ready for re-use. This movement is possible because the cap causes, on being released, the axial displacement of the bracket over the peripheral cut-out of the extension of the rasp, This is mounted here, with sufficient play in order that the arms of the bracket are displaced in an oblique direction over the upper sides of the windows in the main body.

DESCRIPTION OF THE DRAWINGS

In addition to the description in order to facilitate understanding of the characteristics of the invention this description is accompanied by a set of drawings as an integral part of the report, which are an illustration, but not limiting, the following.

PREFERABLE EMBODIMENT OF THE INVENTION

Figure 1:
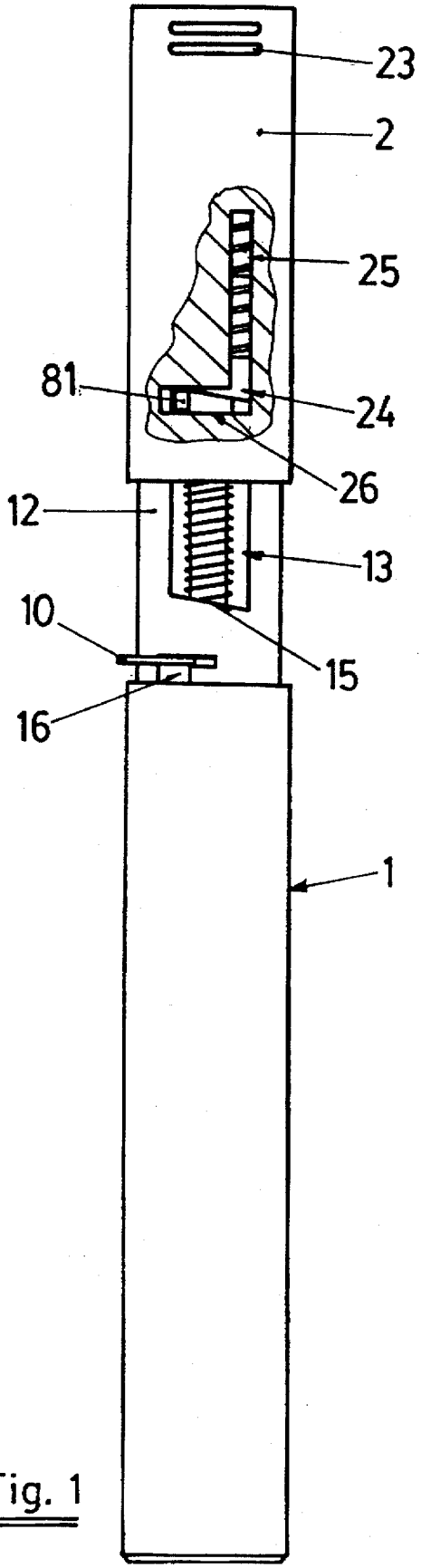
FIG. 1 shows an elevation of the lighter in the off position. A section of the cap has been removed to show one of inner cutaways.
Figure 2:
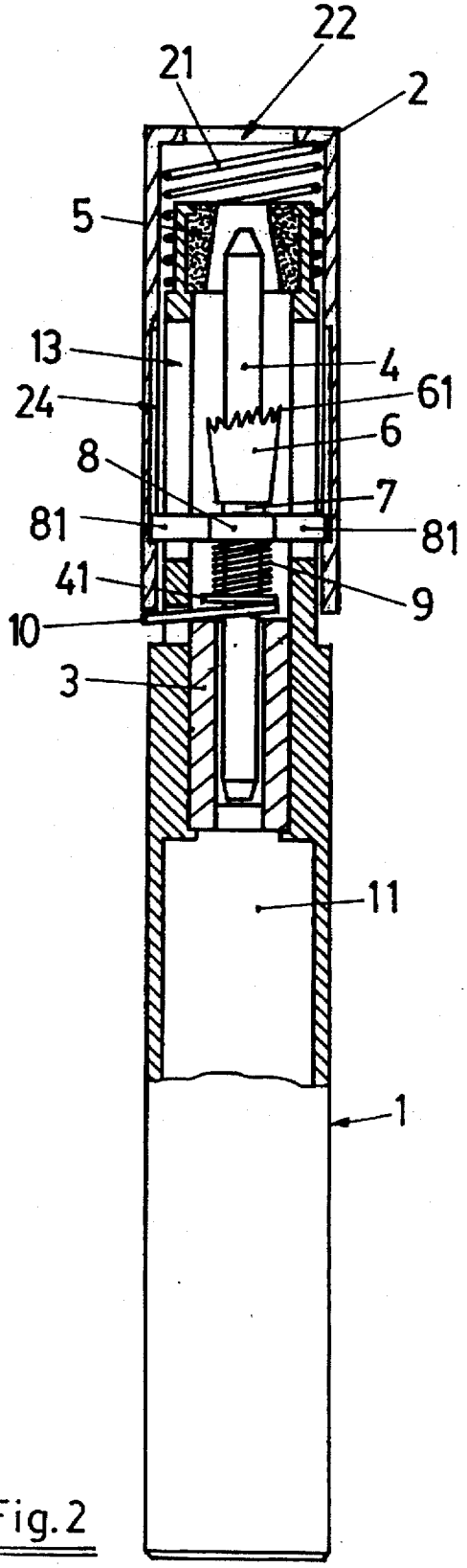
FIG. 2 shows a side view of the lighter in cross section, with the exception of the rasp and the bracket, where the cap is seen in its lowered position prior to operating the rasp.
Figure 3:
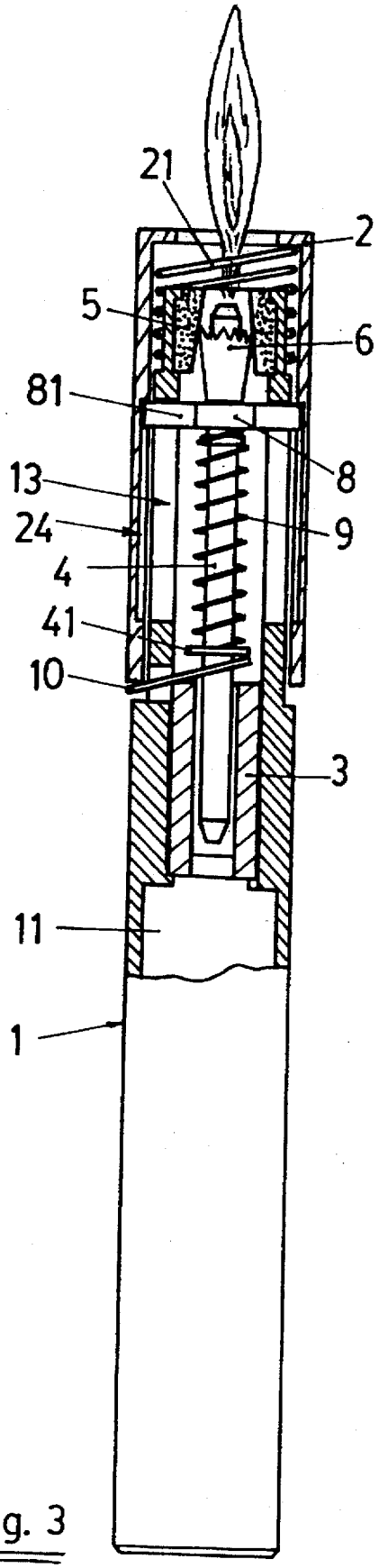
FIG. 3 shows the same view as above, but here the cap is in its lowest position where the flame is lit; in this figure the rasp can be seen in contact with the stone after striking.
Figure 4:
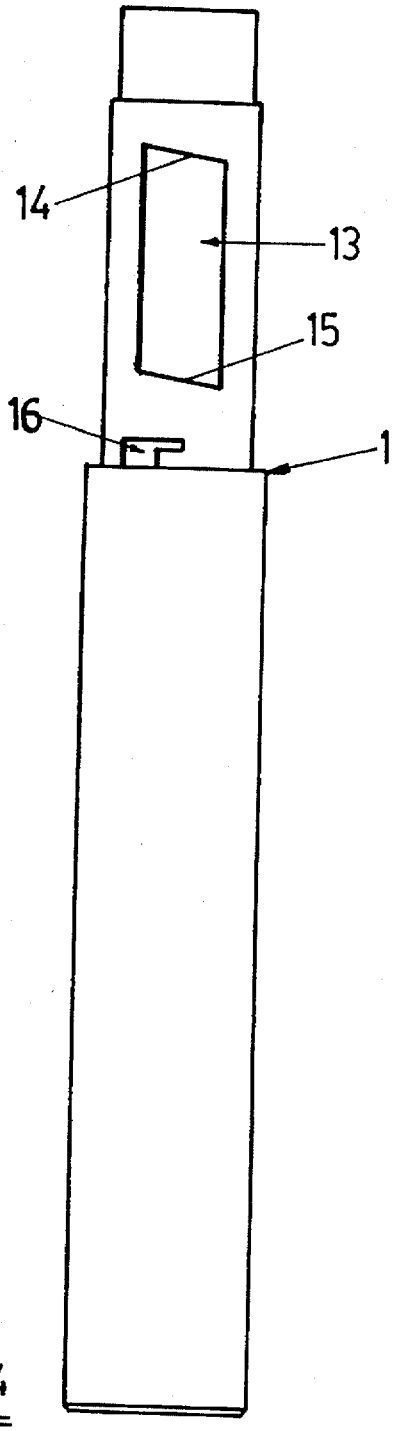
FIG. 4 shows a side view of only the main body of the lighter to show the windows defined in it.
Figure 5:
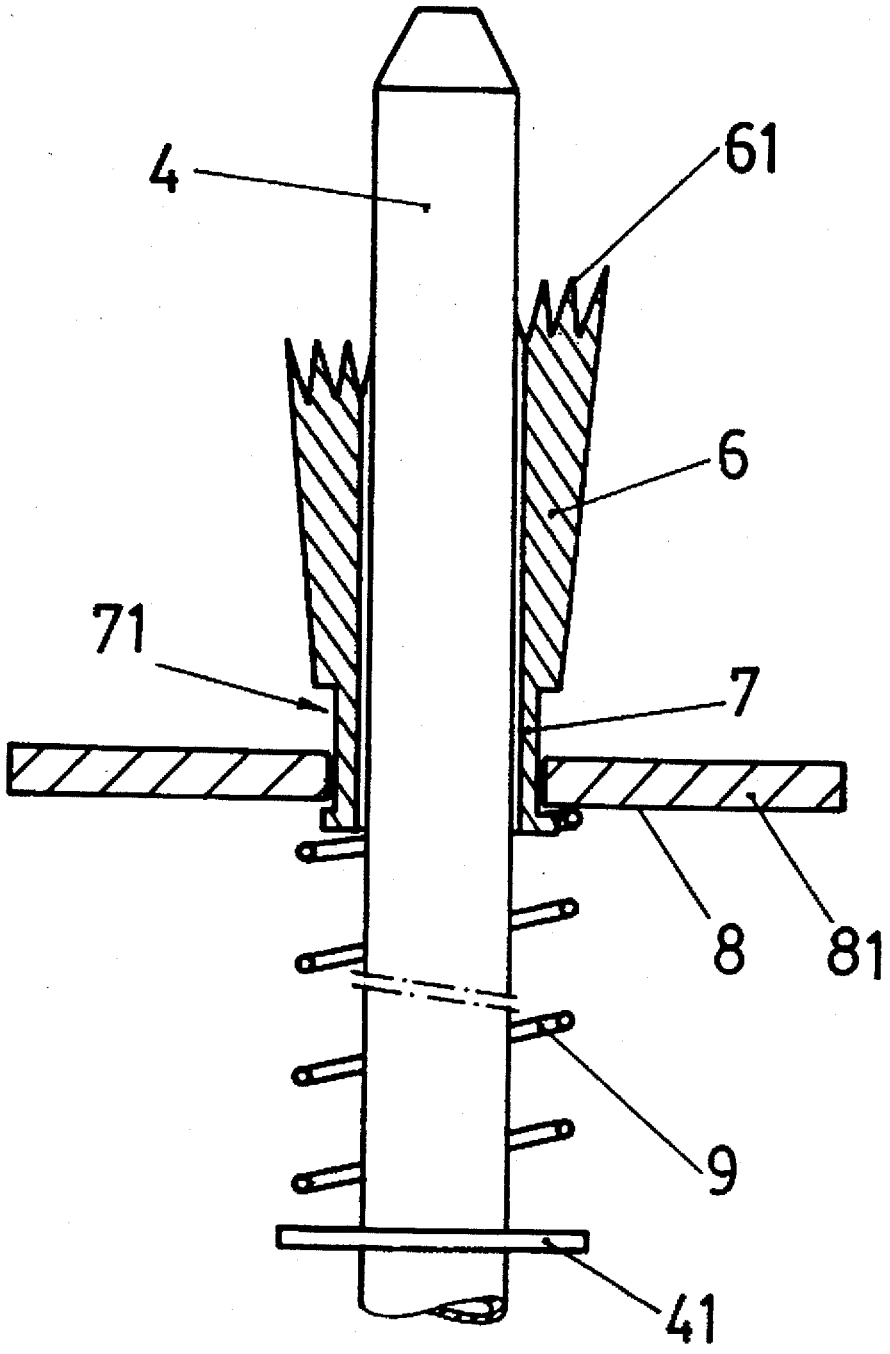
FIG. 5 shows a detailed cross section of the rasp, the bracket and the spring which acts on it, where the assembly of these can be seen on the burner.

As can be seen in the figures mentioned above, the lighter of this invention includes the main body -1- on which a cap -2- is assembled which is moved on its axis. As it is moved towards the lower part of the main body -1- this causes the flame to light.

The main body -1- includes in its lower part a gas reservoir -11- equipped with a valve -3- and a burner -4- and on the upper part a tubular extension -12- with an annular stone -5- internally attached to its end.

On the burner -4- an annular rasp -6-, with a frustoconical inside surface, is mounted with the possibility of axial movement. The top end of said rasp is oblique with frontal teeth -61- while on the lower end there is a tubular extension -7- with a cutaway edge -71-. A bracket -8- is mounted on this cutaway edge -71- which can move axially along the cutaway -71-.

Onto the burner -4- as well as the rasp -6- a helicoidal spring -9- is fitted which with its lower end sits on a widened area -41- in the burner -4- and at the top end comes up to the bottom surface of the bracket -8-.

The tubular part -12- of the main body -1- has two windows -13- in its sides facing each other, whose upper and lower ends -14- and -15- have an oblique parallel shape. The arms -81- of the bracket -8- pass through these windows -13-.

Between the widened area -41- of the burner -4- and the body of the valve -3- there is an operating lever -10- which sticks radially out from the tubular section -12- through an inverted L-shaped window -16-.

The lever -10- can be rotated horizontally with respect to the burner -4- and emerge from the body -1- through a horizontal part of the window -16-, thus holding closed the gas opening, or through the vertical part of the window -16- meaning it can be moved vertically to open the gas valve when the cap -2- presses down on the lever.

The cap -2- is mounted on a main body -1- with an intermediary spring -21- which holds it in its uppermost position with respect to the main body -1-, i.e. in the off position.

In the front of the cap -2- there is an outlet -22- for the flame and on the side some slits -23- for the entry of the air needed for combustion.

The cap -2- has inside two diametrically opposed cutaways -24- where the arms -81- on the bracket -8- are housed.

The cutaways -24- are L-shaped with a vertical section -25- and a horizontal section -26-.

The axial assembly of the different components of the lighter means that with the lighter in the off position, the cap -2- in its uppermost position with respect to the main body -1-, and when the cap -2- is moved to the lower part the spring -9- is compressed and the rasp -6- is lowered. When the cap -2- is at the end of its travel it operates the lever -10- and opens the gas valve and then as the bracket -8- hits the lower end -15- of the window -13- it moves in an oblique direction and frees the arms -81- from the horizontal sections -26- of the windows -24-. This freeing of the bracket -8- and the action of the spring -9- against it causes the rasp -6- to strike the stone -5- and thus cause the sparks needed to light the gas coming through the upper end of the burner -4-. The flame stays lit until the cap -2- is released.

In lit position the arms -81- on the bracket push against the lowest part of the top oblique sides -14- of the windows -13- as the vertical sections -25- of the windows on the cap prevent the arms -81- from moving against the top part -14- of the windows -13- of the main body.

When the cap -2- is released it returns to its starting "off" position via the action of the spring -21- and the bracket -8- moves axially on the cutaway -71- on the extension -7- gaining sufficient height for the arms -81- of the bracket -8- to move obliquely on the top part -14- of the windows -13-. The arms -81- are then housed in the horizontal section -26- of the window -24- on the cap so that the lighting mechanism is automatically reloaded.

When the cap is released and the lighter is lit, the cap no longer acts on the lever -10- and the action of the spring -9- on the widened area -41- on the burner makes the lever automatically return to the position to close the gas valve.

This description does not need to be any more detailed for an expert in the subject to be able to understand the scope of the invention and its advantages.

The terms of this report should be interpreted in the broadest sense and not considered limiting.

The materials, shape, size and positioning of the elements can always be varied as long as this does not alter the essential characteristics of the invention which are claimed below.

I claim:

1. A lighter comprising:

a main body having a longitudinal axis, an upper part defining a tubular extension, and a lower part;

an axially displaceable cap on said upper part of said main body;

an annular stone internally fixed on an end of said tubular extension;

a gas reservoir in said main body, said gas reservoir being equipped with a valve having an opening and a burner having a widened area;

a rasp mounted on said burner above said widened area, said rasp being axially moveable along said burner; and a helicoidal spring resting on said widened area of said burner.

2. A lighter as in claim 1, wherein said rasp has an annular configuration, said burner being mounted therethrough.

3. A lighter as in claim 2, wherein said rasp has a frustoconical external surface.

4. A lighter as in claim 3, wherein said annular stone has an internal frustoconical surface.

5. A lighter as in claim 1, wherein said stone and said rasp are located axially opposite one another.

6. A lighter as in claim 1, wherein said rasp has an upper end with irregular front teeth defined along an oblique plane.

7. A lighter as in claim 1, wherein said tubular extension of said main body has two diametrically opposed side windows having upper and lower ends that are oblique with respect to said longitudinal axis of said main body and parallel with respect to each other.

8. A lighter as in claim 7, further including a bracket mounted on said rasp, said bracket having arms that emerge radially from said main body through said side windows.

9. A lighter as in claim 8, wherein said bracket has a lower surface and said spring has an upper end, said upper end of said spring acting against said lower surface of said bracket.

10. A lighter as in claim 1, wherein said rasp has a lower end with a tubular extension having a peripheral cutaway.

11. A lighter as in claim 10, further including a bracket axially movably mounted on the peripheral cutaway of said tubular extension of said rasp.

12. A lighter as in claim 1, further including an operating lever for said gas valve positioned between said widened area of said burner and said valve.

13. A lighte as in claim 12, wherein said main body further comprises a window and said lever emerges radially from said main body through said window.

14. A lighter as in claim 13, wherein said window has an inverted L-shaped configuration such that said window has an upper horizontal part and a lower vertical part.

15. A lighter as in claim 14, wherein said lever is rotatably mounted with respect to said burner so that said lever can alternately be located opposite said horizontal part or said vertical part of said window, thus adopting, respectively, a position which blocks or unblocks the opening of said gas valve.

16. A lighter as in claim 1, further including a spring placed between said cap and said main body, said spring displacing said cap away from said main body to a position corresponding to an off position.

17. A lighter as in claim 1, wherein said cap defines a front opening for the exit of flame from said burner and lateral slots for the entry of air required for combustion.

18. A lighter as in claim 1, further including a bracket mounted on said rasp and having arms with ends, said cap further including two internal cutaways in which said ends of said bracket arms are located.

19. A lighter as in claim 18, wherein said cutaways of said cap are diametrically opposed.

20. A lighter as in claim 18, wherein said cutaways of said cap have an L-shaped configuration made up of a vertical section and a horizontal section.

* * * * *